United States Patent [19]

Brissette et al.

[11] 3,965,525

[45] June 29, 1976

[54] SHAG RAKE ATTACHMENT FOR UPRIGHT VACUUM CLEANER

[76] Inventors: Edward C. Brissette, 790 Woodside Lane, Apartment 12, Sacramento, Calif. 95825; Edwin W. Smith, Jr., 2700 Saddletree Lane, Rocklin, Calif. 95677

[22] Filed: May 9, 1975

[21] Appl. No.: 575,992

[52] U.S. Cl. ..... 15/373; 15/402

[51] Int. Cl.[2] ..... A47L 9/06

[58] Field of Search ..... 15/368, 393, 397, 410, 15/402, 414, 392, 373

[56] References Cited

UNITED STATES PATENTS 3,825,972 7/1974 MacFarland ..... 15/402 X

*Primary Examiner*—Christopher K. Moore

*Attorney, Agent, or Firm*—Lothrop & West

[57] ABSTRACT

Mounted on the front of an upright vacuum cleaner nozzle is a rake for lifting the pile of a shag rug as the vacuum cleaner is pulled in a backward direction. Provision is made for selectively lengthening or shortening the rake to match the width of the nozzle and for angularly positioning the rake either up out of the way or into engagement with the rug pile at the optimum raking angle.

11 Claims, 2 Drawing Figures

SHAG RAKE ATTACHMENT FOR UPRIGHT VACUUM CLEANER

BACKGROUND OF THE INVENTION

The market place as well as the patent literature provide examples of shag rake attachments for vacuum cleaner nozzles. So far as known, however, the attachments heretofore available, such as the one disclosed in U.S. Design Pat. No. 234,335 dated Feb. 18, 1975, have not been adjustable as to rake length and tooth angle.

Since upright vacuum cleaners come in many different sizes and configurations it is desirable to be able to fit one type of rake attachment to substantially all makes of vacuum cleaners.

SUMMARY OF THE INVENTION

The invention relates generally to shag rug rake attachments for upright vacuum cleaner nozzles and, more particularly, to attachments of this nature which can be adjusted to fit substantially all such nozzles, which enable the user to adjust the angle of attack of the rake teeth to the optimum value and, if desired, allow the user to swing the rake up and out of engagement with the rug pile.

It is an object of the invention to provide a shag rug rake attachment for upright vacuum cleaner nozzle which can readily be attached to a wide variety of nozzle types either at the factory or by the ultimate user.

It is another object of the invention to provide a shag rake attachment which is relatively economical in cost, compact in size and light in weight, yet is trouble free and long lived.

It is still another object of the invention to provide a shag rake attachment which can easily be installed and operated even by a person who is not mechanically inclined owing to the fact that the device is self-contained and does not require the use of any hand tools either in installing it on the nozzle or in using it to rake a shag rug.

It is a further object of the invention to provide a generally improved shag rake attachment.

Other objects, together with the foregoing, are attained in the embodiment described in the following description and illustrated in the accompanying drawing.

SHORT DESCRIPTION OF DRAWING FIGURES

FIG. 1 is a fragmentary, exploded, front perspective view of the rake attachment mounted on a nozzle having a vertical mounting surface, with portions of the tooth mounting bar broken away to reveal interior details; and, FIG. 2 is a fragmentary sectional view of the rake attachment mounted on a nozzle having a sloping mounting surface, and showing the rake in two different angular locations, the plane of the section through the attachment being indicated by the line 2 — 2 in FIG. 1.

DETAILED DESCRIPTION OF PREFERRED EMBODIMENT

Figure 1:
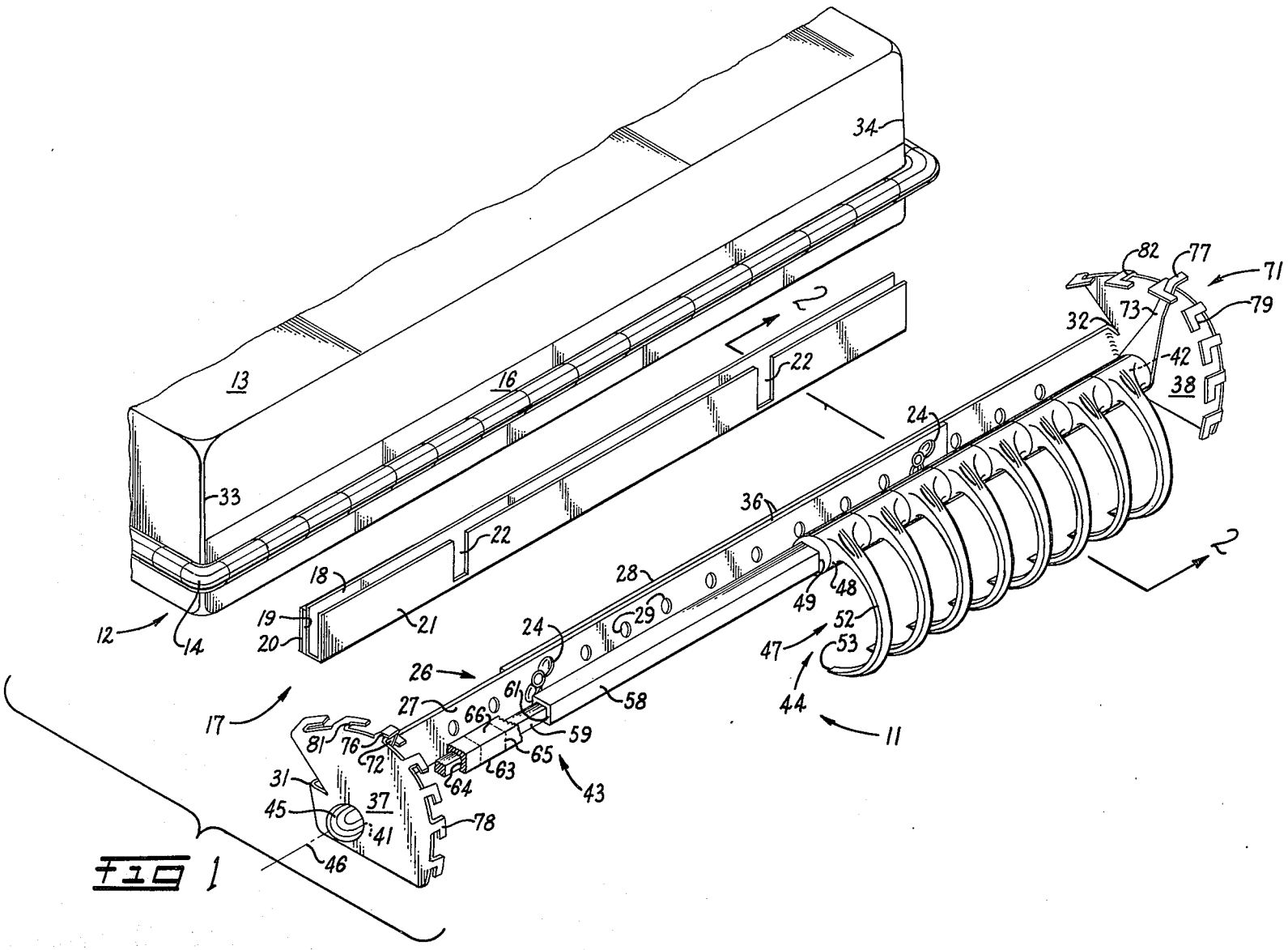

While the shag rake attachment of the invention is susceptible of numerous physical embodiments, depending upon the environment and requirements of use, substantial numbers of the herein shown and described preferred embodiment have been made, used, tested and sold and all have performed in an eminently satisfactory manner.

The attachment of the invention, generally designated by the reference numeral 11, is mounted on the front end of the transverse suction nozzle 12 typically found on an upright type of vacuum cleaner 13, the nozzle including a protective rubber bumper 14.

In many instances, as appears in FIG. 1, for example, the front end of the nozzle affords a planar vertical surface 16, or band, extending across the transverse width of the nozzle. Advantage is taken of this band. It is utilized as a mounting surface for a mounting channel 17 which is U-shaped in cross-section.

The after surface of the rear flange 18, or wall, of the channel 17 is provided at the factory with a layer 19 of pressure-sensitive adhesive material protected until the time of installation by the customary strip shield 20 which is peeled away when the channel 17 is to be mounted on the nozzle. Once installed, the channel 17 remains permanently affixed to the cleaner.

The front flange 21, or wall, of the channel is provided with a spaced pair of openings 22 through which extend the threaded stems of a respective pair of bolts 23 with wing nuts 24 serving to clamp together the front flange 21 of the channel 17 and an elongated adjustable frame 26 disposed within the channel.

The frame 26 comprises two portions 27 and 28 arranged in overlapping relation. In both portions 27 and 28 equally spaced openings 29 are provided so that when the ends 31 and 32 of frame 26 are located adjacent the respective ends 33 and 34 of the nozzle 12 and the openings 22 in the channel 17 are each in register with two registering openings 29 in the overlapped section 36, the wing nuts 24 are tightened, thereby establishing the proper frame length and securing the frame 26 to the mounting channel 17 and thus to the nozzle of the machine.

If desired, the frame 26 can remain permanently installed on the vacuum cleaner.

The ends 31 and 32 of the frame 26 have mounted thereon a respective pair of sector plates 37 and 38 at the rotational centers of which are journaled the respective ends 41 and 42 of an elongated bar 43 carrying a rake 44. The portion of the bar spanning the plates 37 and 38 is square in cross-section. However, the journal ends 41 and 42 of the bar 43 are cylindrical, the transition being marked by stepped shoulders 39 bearing against the inner surfaces of the sector plates to prevent endwise, or translational, movement of the bar 43 although allowing rotational movement thereof about the transverse longitudinal axis 46. Threadably engaged with tapped openings in the ends of the bar is a pair of threaded stems carrying resilient bumpers 45.

The rake 44 includes a plurality of pile engaging teeth 47 each having a root 48 with a square in section bore 49 defined by walls 51 snugly engageable with the square in section bar 43. From the root 48 the tooth 47 projects arcuately forwardly and downwardly through a shank portion 52, terminating in a tip 53 engageable with the pile 54 of a shag rug 56 when in raking mode, as appears most clearly in broken line in FIG. 2.

As will be appreciated, raking only occurs on the backstroke, or rearward travel, of the vacuum cleaner. In the forward, pushing stroke, the tips 53 of the somewhat flexible teeth 47 knuckle under. When the machine is moving aft, however, the tips 53 of the teeth engage the pile and in raking through the rug 56 yield the desired pile-lifting effect.

Just as the frame 26 is selectively adjustable as to length, in order to match the transverse width of the nozzle 12, so also are the rake bar 43, and the attendant rake 44, adjustable so as to span the distance between the sector plates 37 and 38 after the frame has been properly fitted to the nozzle.

The rake bar 43 includes two square in section telescoping portions, one a larger, hollow, square in section sleeve 58, the other a smaller, square in section rod 59, the rod being translatably disposed within the hollow sleeve 58 with some degree of snugness.

The sleeve 58 is, in length, a substantially exact multiple of the length of the individual teeth roots 48 and is long enough so that when the frame 26 is installed on the smallest nozzle on the market the sleeve 58 will span the distance between the sector plates 37 and 38 of the adjusted frame.

For wider nozzles, the inner, telescoping rod 59 is projected beyond the proximal end 61 of the sleeve 58 until the projecting end of the rod 59 can be journaled in the adjacent sector plate 37 of the adjusted frame.

Owing to the fact that the cross-sectional dimensions of the rod 59 are smaller than those of the sleeve 58, and thus of the tooth bore 49, an adapter collar 63 is provided for each tooth which is mounted on the rod 59. Each collar 63 has a length equal to the axial length of the tooth root bore 49, and cross-sectional sizes such that the walls of the axial, square in section opening 64 in the collar 63 snugly encompass the rod 59, and the outer walls of the collar 63 snugly fit in the bore 49 of the tooth 47.

For convenience, five of the collars 63 are molded in aligned, square tube form 66 so that the collars are joined end to end with abscission means 65 located at each junction. Conveniently, the abscission structure 65 comprises a plurality of peripherally arranged notches, or perforations, forming planes of weakness so that the requisite number of collars can be snapped off, leaving the number necessary to span the rod distance between the adjacent sector plate 37 and proximal end 61 of the sleeve 58. Preferably, the collar tube 66 is of rigid plastic material and is provided in an installation kit, five collars being sufficient, when added to the length of the sleeve 58, to extend across the widest marketed nozzle.

An additional feature of great convenience to the user is the mechanism which enables the user to position the rake at the most efficient angle of attack relative to the particular shag rug pile being lifted and, when finished, to lift the rake out of the way.

The rake positioning structure, generally designated by the reference numeral 71, includes a pair of leaf spring levers 72 and 73 mounted at the opposite ends of the tooth carrier bar 43.

In situations where one lever 73 is carried on the sleeve 58 and the other lever 72 is mounted on the rod 59, the respective square openings in the base of the lever will be of differing sizes to fit snugly on the respective larger sleeve 58 and smaller rod 59. The somewhat springy levers 72 and 73 are in parallel relation with respect to each other and move in planes in close proximity to the planes of the respective adjacent sector plates 37 and 38.

Since the respective distal ends 76 and 77 of the levers 72 and 73 are resiliently movable out of the planes of lever movement, a plurality of inwardly projecting notches 78 and 79 in the perimeters of the respective sector plates 37 and 38 can be utilized so as to position the levers, and thus rake 44, in any desired attitude so as to provide optimum results.

Figure 2:
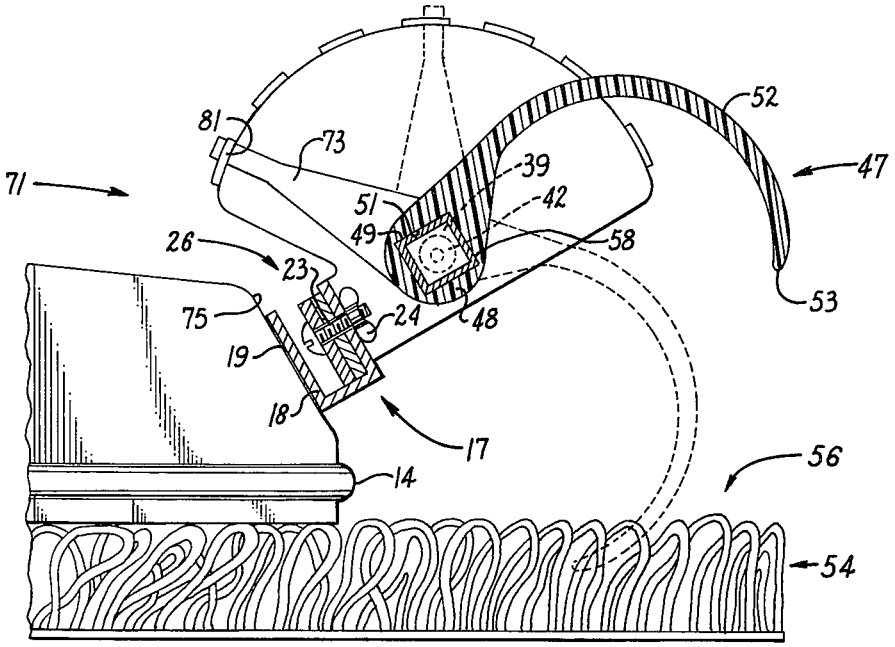

This capability is of especial help when the front mounting surface 75 of the nozzle is inclined from the vertical in a rearward and upward slope, as in the type of vacuum cleaner nozzle shown in FIG. 2. In this situation, the mounting channel 17 is secured by the pressure sensitive adhesive 19 to the sloping surface 75 just as it is to the vertical surface 16 previously described and shown in FIG. 1. Where the surface slopes rearwardly and upwardly, as in FIG. 2, it is only necessary to locate the distal ends of the levers in notches which are more toward the front portions of the sector perimeters so that the teeth will engage the pile at the optimum angle. The notches are angularly spaced approximately 20° apart, thereby affording a wide range of attack angles.

At the conclusion of the raking, the distal ends 76 and 77 of the levers are urged inwardly and disengaged from their respective notches, then swung rearwardly into an after pair of notches 81 and 82 so that the tips 53 of the teeth 47 are entirely separated from the pile 54 of the rug 56. The rake 44 can be maintained in this disengaged mode until raking again becomes necessary, at which time the levers can be urged out of the notches 81 and 82 and swung forwardly into the most efficient rug engaging positions as determined from prior use and experience, at which location the distal ends of the levers are released and allowed to lodge in the respective notches of the sector plates under leaf spring urgency.

It can therefore be seen that I have provided a shag rug rake attachment for an upright vacuum cleaner which is not only effective in providing optimum pile lifting results but which is also versatile in that it can be installed on a wide variety of machine makes and sizes.

What is claimed is:

1. A shag rake attachment for upright vacuum cleaner having a nozzle oriented transversely to the path of vacuum cleaner travel, said attachment comprising:

a. a transverse frame including means for adjusting said frame to be substantially coextensive in length with said nozzle;

b. means for mounting said frame on said nozzle; and c. a transversely elongated rake mounted on said frame, said rake being substantially coextensive in length with said frame and parallel thereto, said rake including a plurality of teeth capable of engaging the shag as the vacuum cleaner is moved along the path of travel.

2. A shag rake attachment as in claim 1 in which said adjusting means includes a pair of overlapping frame portions and means for clamping together said overlapping portions.

3. A shag rake attachment as in claim 2 in which said clamping means is a pair of wing nuts and bolts passing through registering openings in said overlapping portions.

4. A shag rake attachment as in claim 3 in which said frame mounting means includes a U-shaped in section channel having an inner wall coated with a pressure-sensitive adhesive for affixing said channel to said nozzle, and an outer wall provided with a pair of openings to receive said bolts with said overlapping portions located in said channel.

5. A shag rake attachment as in claim 1 including means for selectively angularly positioning said rake relative to said frame.

6. A shag rake attachment as in claim 5 wherein said rake positioning means includes an elongated bar journaled between the opposite ends of said frame, and means for rotating said bar about its longitudinal axis, said teeth being mounted on said bar for rotation therewith.

7. A shag rake attachment as in claim 6 in which said bar rotating means includes a spring leaf lever mounted on said bar, and in which said frame includes a sector plate located in close proximity and parallel to said lever, said sector plate having a plurality of notches selectively engageable with the distal end of said lever, said distal end of said lever being capable of being biased away from said notches while shifting said lever from one of said notches to another of said notches.

8. A shag rake attachment as in claim 7 in which said notches are angularly spaced apart and extend between a first forwardmost notch in which said lever when engaged holds said teeth in engagement with the shag rug and a second aftermost notch in which said lever when engaged holds said teeth in a location removed from the shag rug.

9. A shag rake attachment as in claim 8 in which said bar includes an outer hollow square in section sleeve journaled in one of said ends of said frame, and an inner square in section rod journaled in the other of said ends of said frame and being in telescoping relation with said sleeve, and in which each of said teeth comprises a root having a square in section bore defined by walls snugly engageable with said sleeve, a shank projecting arcuately outwardly from said root, and a shag engageable tip on the end of said shank.

10. A shag rake attachment as in claim 9 including a hollow, square in section adapter collar, said collar having an outer size in section substantially identical to the outer size in section of said sleeve and an inner size in section enabling said collar to fit snugly on said rod, the length of said collar being substantially identical to the length of said bore in said root of said tooth, said collar when located within said bore enabling the respective tooth to fit snugly on said rod.

11. A shag rake attachment as in claim 10 including a plurality of said collars joined together in aligned relation with abscission means at each junction for selectively separating one or more of said collars from said plurality in order to leave a predetermined number corresponding to the number of teeth required to span the distance between said other of said ends of said frame and the proximal end of said sleeve.

* * * * *